US005401103A

United States Patent [19]

De Jong et al.

[11] Patent Number: 5,401,103

[45] Date of Patent: Mar. 28, 1995

[54] GUIDE SEAT FOR AN ELEVATOR CAR FOR DAMPENING OF STRUCTURE-BORNE NOISE

[75] Inventors: Johannes De Jong, Järvenpää; Ilkka Nousiainen, Helsinki, both of Finland

[73] Assignee: Kone Elevator GmbH, Baar, Switzerland

[21] Appl. No.: 992,732

[22] Filed: Dec. 18, 1992

[30] Foreign Application Priority Data

Dec. 18, 1991 [FI] Finland ..... 915954

[51] Int. Cl.[6] ..... B66B 7/04

[52] U.S. Cl. ..... 187/409

[58] Field of Search ..... 384/33, 37, 54, 58; 187/95; 267/168, 170

[56] References Cited

U.S. PATENT DOCUMENTS

| | | | |
|---|---|---|---|
| 2,490,652 | 12/1949 | Sahlin | 187/95 |
| 2,498,299 | 2/1950 | Rissler | 187/95 |
| 3,329,240 | 7/1967 | Harwood et al. | 187/95 |
| 3,856,117 | 12/1974 | Solymos | 187/95 |
| 5,107,963 | 4/1992 | Rocca et al. | 187/95 |

FOREIGN PATENT DOCUMENTS

| | | | |
|---|---|---|---|
| 0137236 | 4/1985 | European Pat. Off. | 187/95 |
| 1231833 | 4/1960 | France | 187/95 |
| 1060116 | 6/1959 | Germany . | |
| 1067195 | 10/1959 | Germany . | |
| 1270248 | 6/1968 | Germany . | |
| 1556912 | 9/1969 | Germany . | |
| 3413594 | 6/1985 | Germany | 187/95 |
| 0098650 | 8/1978 | Japan | 187/95 |
| 422195 | 2/1982 | Sweden . | |
| 787386 | 6/1955 | United Kingdom . | |
| 921714 | 10/1959 | United Kingdom . | |
| 944222 | 2/1960 | United Kingdom . | |
| 188638 | 9/1966 | U.S.S.R. | 187/95 |

*Primary Examiner*—Daniel P. Stodola

[57] ABSTRACT

Guide seat for an elevator car, which supports a guide moving along a guide rail (6). The guide seat comprises a fixing part by which the guide seat is attached to the car structure (2), and a base plate (12,26,33) on which a guide structure is mounted. To pass the forces between the guide rail (6) and the elevator car (1), the guide seat is provided with at least one insulator (17,30,32) made of an elastic material, such as rubber. The insulator is placed between the fixing part and the base plate.

13 Claims, 3 Drawing Sheets

GUIDE SEAT FOR AN ELEVATOR CAR FOR DAMPENING OF STRUCTURE-BORNE NOISE

FIELD OF THE INVENTION

The present invention relates to a guide seat for an elevator car.

DESCRIPTION OF THE BACKGROUND ART

Especially in the case of fast high-quality elevators, travelling comfort has become an aim of increasing importance, but this question is receiving more attention in the case of other elevators as well. One of the factors affecting travelling comfort is the noise heard in the elevator car. Various noises generated by the elevator equipment reach the ears of passengers in the car. To reduce the noise penetrating into the car, the cabin is provided with sound insulation, but often it is not possible to achieve a sufficient damping of the noise carried into the elevator car by conventional means and at a reasonable cost without making unreasonable compromises relating to the usability of the elevator. The conventional sound insulation used in the walls of the cabin is primarily intended for the suppression of airborne noise and is therefore in most cases insufficient for the insulation of structure-borne noise. This noise includes the noise generated by roller and sliding guides as they run along the guide rails, and also the noise originating from the bearings of roller guides. This kind of noise tends to be transmitted into the cabin via the guide seat and the car frame. In roller guides, each roller is generally provided with springs permitting roller motion relative to the guide frame. The springs are primarily designed to damp the excitations resulting from the unevenness of the guide rails or junctions of guide rails and causing relatively low-frequency oscillations of the elevator car. For the same reason, sliding guide shoes are provided with springs or elastic spacers to attach the sliding blocks to the guide frame. A significant portion of the higher-frequency oscillations, and especially of the oscillation component propagating as structure-borne noise, is passed through this type of spring systems because the springs of guide rollers and sliding blocks are primarily designed with a view to the oscillation of the relatively large mass of the elevator car. The problem of structure-borne noise is emphasized in self-supporting car solutions with the guides attached directly to the shell of the cabin.

SUMMARY OF THE INVENTION

The object of the present invention is to provide a new type of guide seat to solve the problem of structure-borne noise.

The elevator guide seat of the invention is characterized by an elevator car guide seat having a fixing plate, a base plate having guide rollers and a cover plate. Between the plates at least one elastic insulator is provided. The insulator is held in position by bushings which center the at least one insulator around holes provided in the plates. Other embodiments Of the invention are possible.

The advantages provided by the invention include the following:–

Due to the lower level of noise audible in the elevator car, passengers find it more pleasant and even safer to use the elevator. The invention makes it possible to achieve a cabin noise level several decibels below that of an elevator without insulating guide seats.

The solution of the invention is applicable to most elevators and permits easy installation of new guide seats in old elevators e.g. in connection with modernization.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention is described by the aid of an example by referring to the attached drawings which are given by way of illustration only, and thus are not limitative of the present invention, and in which.

DETAILED DESCRIPTION OF THE PREFERRED EMBODIMENT

Figure 2:
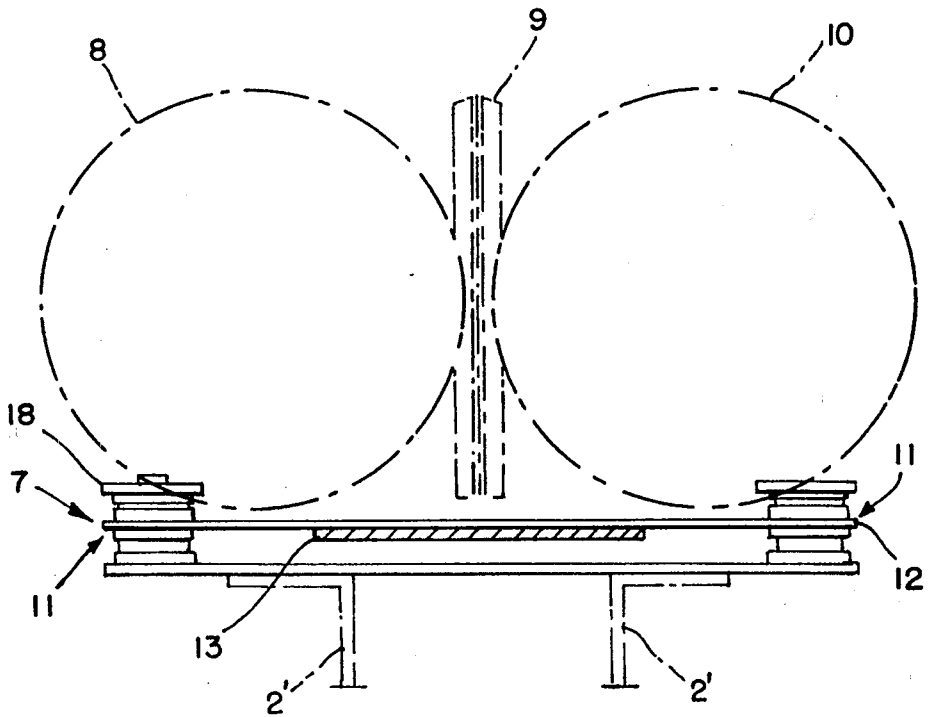
FIG. 2 presents the insulating guide seat of the invention as seen from the direction of the guide rail.
Figure 1:
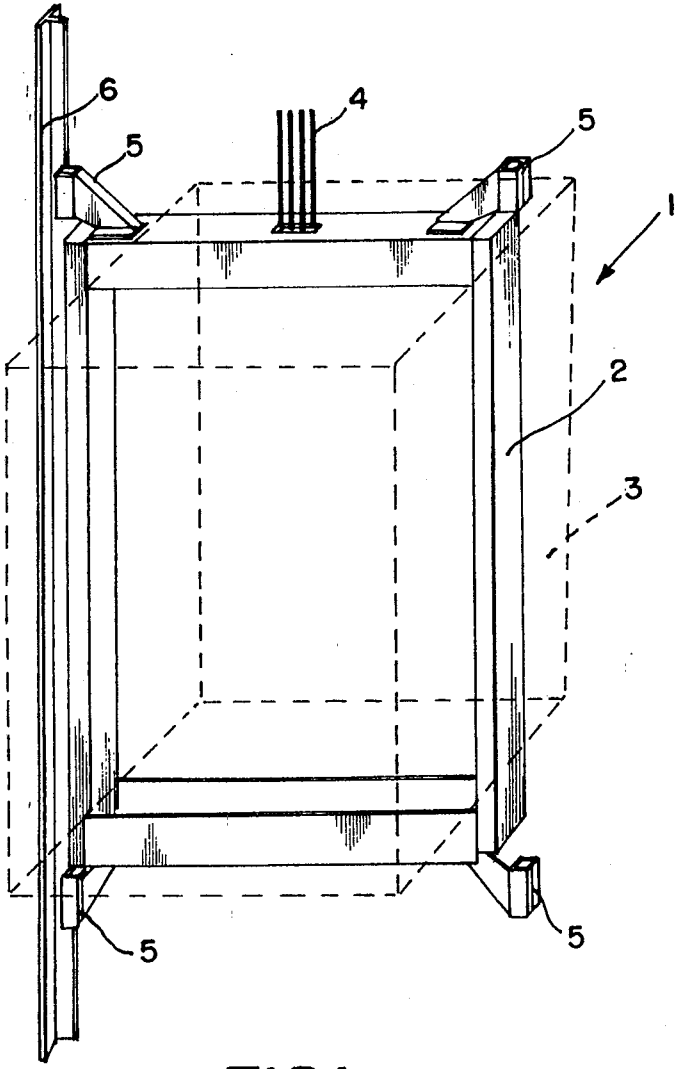
FIG. 1 is a diagram representing an elevator car.

The diagram in FIG. 1 represents an elevator car 1. The car frame 2 supports and surrounds a cabin 3. The hoisting ropes 4 are attached to the car frame. The guides 5 of the elevator car are attached to the overhead and bottom beams of the car frame. The guides can be either sliding guides or roller guides as seen in FIGS. 1 and 2, respectively. By means of the guides 5, the elevator car is held steady by the elevator guide rails 6, of which only one is shown in the drawing. The guide rails control the horizontal motion of the elevator car.

In FIG. 2, the guide seat 7 of the invention is seen from the direction of the guide rail. The guide seat is attached to the beam structures 2' of the elevator car frame e.g. by means of bolts. On the other hand, mounted on the guide seat is a roller guide structure, represented in the figure by rollers 8,9,10. The guide seat of the invention uses an arrangement whereby the supporting forces between the roller guide structure and the car frame 2 are transmitted via insulating structures 11. The roller guide structure may consist of a prefabricated roller guide which is fixed onto the guide seat, or it may be a structure integrated with the guide seat. In the case of a structure integrated with the guide seat, the roller guide and the guide seat have at least one part in common, i.e. at least the roller guide base plate 12 in the guide seat is part of the frame of the roller guide, or vice versa. In addition to providing insulation between the roller guide and the elevator car 1, the structure of the invention allows the mass vibrating with the roller guide to be varied e.g. by attaching an extra weight 13 to the base plate.

Figure 3:
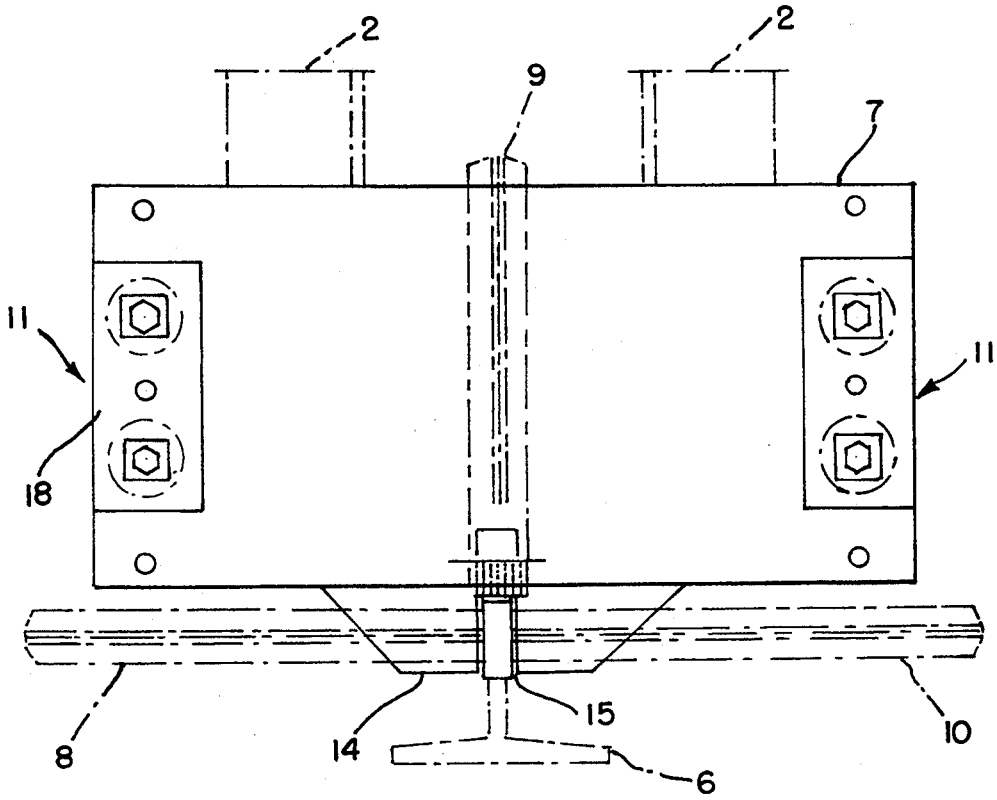
FIG. 3 presents the insulating guide seat of the invention as seen from above.

FIG. 3 shows the guide seat 7 as seen from the vertical direction. The rollers 8,9,10 of the roller guide, the guide rail 6 controlling lateral elevator motion, and the car frame beams 2' have been drawn in broken lines. The insulating structures 11 are placed on the sides of the guide seat at essentially the same distance from the middle roller 9. Integrated with the guide seat is also a motion limiter 14 comprising an opening 15 in which the guide rail 6 runs. The motion limiter prevents lateral car motions exceeding the allowed limit. Forces within the normal operating range are transmitted via insulators 17.

Figure 4:
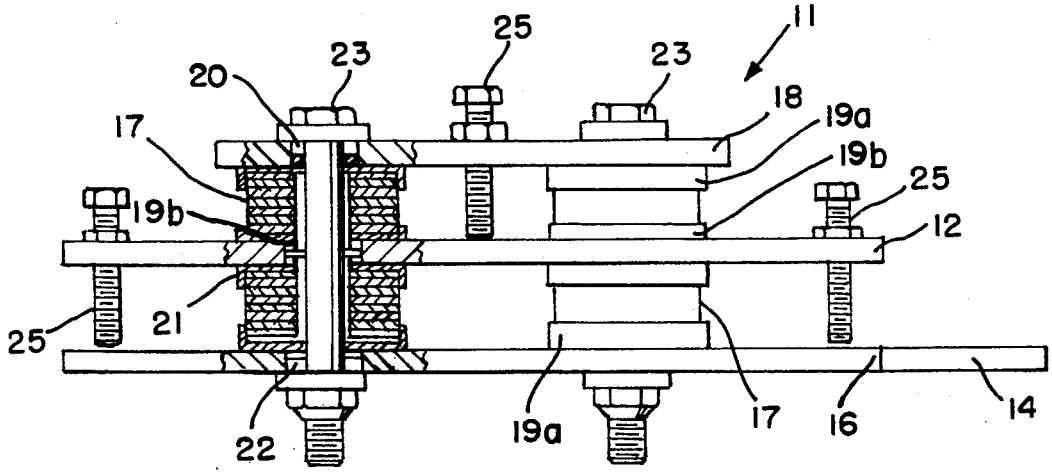
FIG. 4 presents a partial cross-section of the insulating guide seat of the invention as seen from one side.

FIG. 4 presents a partially sectioned lateral view of the guide seat, showing its essential parts. These include a bottom plate 16, which is also the part by which the guide seat is fixed to the elevator car frame; a roller guide base plate 12, to which the roller guide is attached or which, in an integrated structure, carries the roller guide part proper; and an insulating structure 11. The insulating structure 11 consists of rubber insulators 17 and a cover plate 18, which are held together by bolts 23 going through the cover plate, base plate, bottom plate and rubber insulators. The bolts 23 attach the structural parts of the guide seat to the bottom plate and also set the height of the structure, depending on the tightness to which the screws are tightened. The rubber insulators 17 are held in position between the plates by bushings **19*a*, 19*b*, which center the rubber insulators 17 around the holes 20,21,22 in the cover, base and bottom plates. In bush 19*a*, the hole for the bolt 23 is dimensioned according to the bolt diameter so that it braces the bolt laterally, whereas in bushes 19*b* the hole is large enough to ensure that the bolts 23 will not touch bushes 19*b* during elastic deformation of the insulators. The guide seat is provided with limiters, such as screws 25, to limit the motion of the plates (12,16,18) relative to each other. The motion limiter screws 25 can also be used to bypass the insulating function of the guide seat e.g. during installation. The edge of the bottom plate 16 facing the guide rail is shaped to form a motion limiter 14**, which prevents motions exceeding the allowed operating range of the guide seat.

Figure 5:
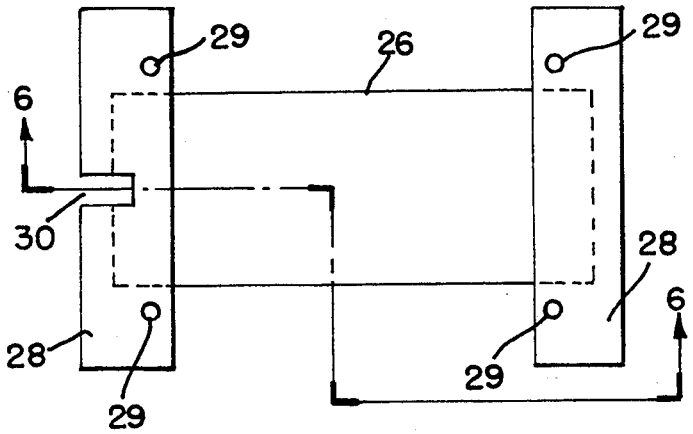
FIGS. 5 and 6 present another embodiment of the insulating guide seat of the invention in top view and in side view, the side view being a partial section seen from direction A—A.
Figure 6:
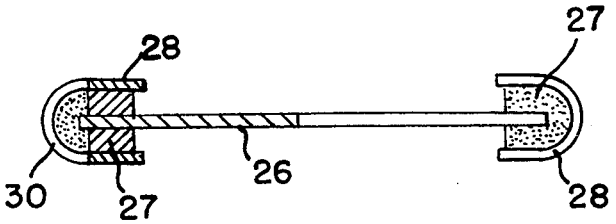

FIGS. 5 and 6 present another embodiment of the guide seat of the invention in a simplified form, FIG. 6 showing the guide seat in side view, FIG. 5 in top view. In this guide seat, the fixing part consists of a pair of channel iron members 28 with their open sides facing each other. The base plate 26 is fitted between the channels, extending into the channel troughs, and supported and fixed in place by means of an insulating mass 27 vulcanized between the channels and the base plate. There is no contact between the base plate 26 and the channels 28. The guide itself is fixed to the base plate 26, while the guide seat is fixed to the elevator car by means of bolts placed in holes 29. The figure does not show how the guide is attached to the base plate, but this can be done e.g. with the aid of mounting holes (not shown) provided in the plate. A limiter 30 corresponding to motion limiter 14 has been formed by making a suitable cut-out in the outer edge of one of the channel members. Corresponding cut-outs are also provided in the rubber insulation and in the base plate.

Figure 7:
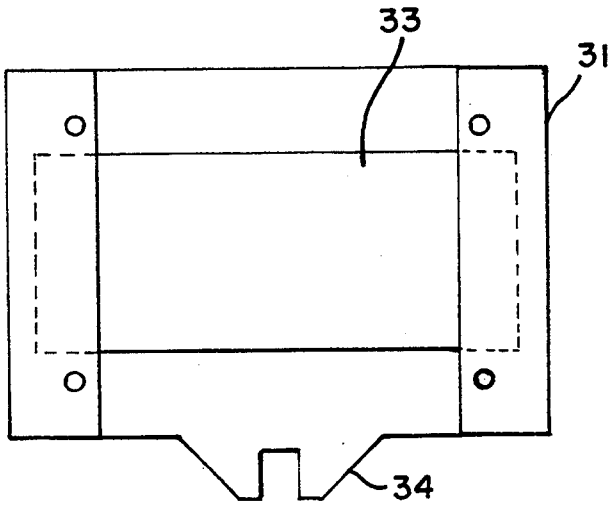
FIGS. 7 and 8 present yet another embodiment of the insulating guide seat of the invention in top view and in side view.
Figure 8:
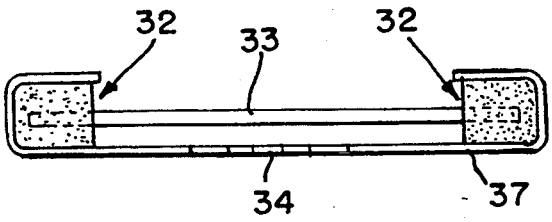

FIGS. 7 and 8 illustrate a solution resembling that in FIG. 5 and 6. In this case, the fixing part 31 consists, instead of a pair of channels, of a plate whose two opposite sides have been bent so as to form two troughs 32. The base plate 33 of the guide seat extends into the troughs 32 of the fixing part and is attached to the latter by means of an insulating rubber mass in the troughs. The plate is provided with a motion limiter 34 formed at one of its unbent edges.

In the solutions of the invention, the elastic insulating material in the guide seat damps structure-borne noise propagating via structural parts. Typically, the noise to be damped falls within a frequency range from a few herz (Hz) to a few kiloherz (kHz). The damping efficiency depends on the thickness of the layer of insulating material. The elastic insulating material also acts as a part of the spring suspension system of the car. In this case, however, the action mechanism is based on the overall deformations of the block of insulating material rather than on damping of structure-borne sound, for which the dominating characteristics are those relating to the transmission of vibration at the frequency in question.

It is obvious to a person skilled in the art that different embodiments of the invention are not restricted to the examples described above, but that they may instead be varied within the scope of the following claims. For example, the motion limiter can be formed in other ways besides shaping the guide seat frame as described in the examples, e.g. by attaching the required additional elements to the fixing part. Also, the plates presented in the examples could be bent so as to produce a guide seat with a lower effective height. This could be achieved e.g. by forming a recess in the base plate at the location where the guide structure is to be placed.

It is also obvious to a person skilled in the art that the base plate itself contributes to the springing of the guide. The contribution is particularly advantageous in the case of roller guides, whose spring system often provides but an insignificant degree of internal damping, because the insulating rubber in the guide seat of the invention acts as a damping element in the spring system.

We claim:

1. A guide seat for an elevator car, the guide seat supporting a guide moving along a guide rail, said guide seat comprising:

a fixing plate for fixing the guide seat to a frame of the elevator car, the fixing plate having at least one hole therein;

a cover plate having at least one hole therein;

a base plate positioned between the fixing plate and the cover plate, the base plate having at least one hole therein;

guide rollers attached go the base plate;

at least one insulator being provided between the plates, the at least one insulator dampening noise to the elevator car;

bushings for each of the at least one insulators, the bushings being coaxial with the holes provided in the plates;

at least one bolt passing through and being coaxial with the holes in the fixing plate, the cover plate and the base plate to thereby connect the plates, the bolt also passing through the at least one insulator and being coaxial with the bushings and the at least one insulator; and screws for limiting motion of the plates relative to each other, the screws being engageable with an adjacent plate to stop movement of the plates toward one another.

2. The guide seat according to claim 1, wherein the insulator is made of an elastic material.

3. The guide seat according to claim 1, wherein the insulator is made of rubber.

4. The guide seat according to claim 1, wherein the base plate forms a fixed part of a frame of the guide.

5. The guide seat according to claim 1, wherein the fixing plate is provided with a motion limiter for limiting lateral motion of the elevator car relative to the guide rail.

6. The guide seat according to claim 1, wherein the at least one insulator comprises two insulators, one of the two insulators being positioned between the base plate and the fixing plate and another of the two insulators being positioned between the base plate and the cover plate, each of the insulators and the holes in the plates being aligned, and each insulator having a hole provided therein, the bolt passes through the holes in the plates and the insulators to attach the insulators and plates together.

7. The guide seat according to claim 1, wherein the at least one insulator comprises four insulators, the insulators being provided in pairs such that each pair has a first insulator and a second insulator, the first insulators being positioned between the base plate and the fixing plate and the second insulators being positioned between the base plate and the cover plate, each of the plates having two sets of holes, a first and second insulator being aligned with one set of holes in the plates while another first and second insulator being aligned with another set of holes in the plates, each of the four insulators having a hole provided therein, and wherein the at least one bolt comprises two bolts, one of the bolts passing through the holes in the plates and the insulators pairs to attach the insulators and plates together.

8. The guide seat according to claim 1, wherein the at least one insulator comprises two pairs of insulators arranged so that one insulator in each pair is between the base plate and the fixing plate while another insulator in the pair is between the base plate and the cover plate, the insulators having holes therein and wherein the at least one bolt comprises a plurality bolts passing through aligned holes in the plates and insulators for holding the plates and insulators together.

9. The guide seat according to claim 8, wherein the bushings each have holes defined therein and wherein the bolts pass through the holes in the bushings, the cover plate and fixing plate having bushings adjacent thereto which bushings have holes with a diameter corresponding to a diameter of the bolts which pass through the holes.

10. The guide seat according to claim 9, wherein the base plate has bushings adjacent thereto which bushings have holes with a diameter greater than the diameter of the bolts which pass therethrough.

11. The guide seat according to claim 1, wherein the bushings and the at least one insulator each have holes defined therein and wherein the guide seat further comprises at least one bolt passing through the holes in the bushings, in the at least one insulator and in the plates, the cover plate and fixing plate having bushings adjacent thereto which bushings have holes with a diameter corresponding to a diameter of the bolt which pass through the holes.

12. The guide seat according to claim 11, wherein the base plate has bushings adjacent thereto which bushings have holes with a diameter greater than the diameter of the bolt which passes therethrough.

13. The guide seat according to claim 1, wherein the bushings and the at least one insulator each have holes defined therein and wherein the base plate has bushings adjacent thereto and the bolt has a diameter smaller than a diameter of the holes in the bushings adjacent to the base plate.

* * * * *